US005204205A

United States Patent [19]

Anno et al.

[11] Patent Number: 5,204,205

[45] Date of Patent: Apr. 20, 1993

[54] THREE LAYERED TONER FOR ELECTROPHOTOGRAPHY

[75] Inventors: Masahiro Anno; Kazuo Ota; Junji Machida; Eiichi Sano; Makoto Kobayashi, all of Osaka, Japan

[73] Assignee: Minolta Camera Kabushiki Kaisha, Osaka, Japan

[21] Appl. No.: 770,730

[22] Filed: Oct. 4, 1991

Related U.S. Application Data

[63] Continuation of Ser. No. 515,449, Apr. 27, 1990, abandoned.

[30] Foreign Application Priority Data

Apr. 28, 1989 [JP] Japan ..... 1-109941
Apr. 28, 1989 [JP] Japan ..... 1-109942
Apr. 28, 1989 [JP] Japan ..... 1-109943
Apr. 28, 1989 [JP] Japan ..... 1-109944

[51] Int. Cl.[5] ..... G03G 9/093

[52] U.S. Cl. ..... 430/109; 430/110; 430/111; 430/138

[58] Field of Search ..... 430/109, 110, 111, 138

[56] References Cited

U.S. PATENT DOCUMENTS 4,336,173 6/1982 Ugelstad ..... 523/205
4,459,378 7/1984 Ugelstad ..... 523/205
4,601,967 7/1986 Suzuki et al. ..... 430/107
4,828,955 5/1989 Kasai et al. ..... 430/111
4,882,258 11/1989 Ikeuchi et al. ..... 430/109
5,079,125 1/1992 Anno et al. ..... 430/110

FOREIGN PATENT DOCUMENTS 275767 12/1986 Japan .
226162 10/1987 Japan .

*Primary Examiner*—Marion E. McCamish
*Assistant Examiner*—S. Rosasco
*Attorney, Agent, or Firm*—Burns, Doane, Swecker & Mathis

[57] ABSTRACT

This invention relates to toner for the development of electrostatic latent images comprising a core particle comprising at least styrene-acrylic copolymers or polyester resins, an intermediate layer coating the core particle and comprising at least styrene-acrylic copolymers, and an outermost surface layer coating the intermediate layer and comprising at least styrene-acrylic copolymers, the contents (%) of the styrenic monomer component in styrene-acrylic copolymers of which the core particles, the intermediate layers and the outermost surface layers are formed being in specified relationships.

25 Claims, 2 Drawing Sheets a revolving direction of magnetic roll b moving direction of developer a revolving direction of magnetic roll b moving direction of developer

THREE LAYERED TONER FOR ELECTROPHOTOGRAPHY

This application is a continuation of application Ser. No. 07/515,449, filed Apr. 27, 1990, now abandoned.

BACKGROUND OF THE INVENTION

This invention relates to toner for developing electrostatic latent images, more particularly, toner for developing electrostatic latent images used in electrophotography, electrostatic recording and electrostatic printing for formation of copied images with high quality.

In the development of electrostatic latent images in electrophotography, electrostatic recording and electrostatic printing, the electrostatic latent images formed on a photosensitive member are made visible by providing frictionally charged toner.

As a conventional method for charging toner electrically, there are known a two-component developing system in which toner is mixed and stirred with carrier to be charged electrically, and a single-component developing system in which toner is charged tribo-electrically in contact with a developing sleeve, a controlling blade, or a photosensitive member. In either method of the two, unless toner is charged uniformly, there arise disadvantages in a developing process and a transferring process.

Recently, there is provided toner of layered type in order to meet requirements for high resolving power, high quality, various functions or diverse uses.

The layered toner is formed of plural layers, each of which is given different functions so that properties required for toner such as fixing properties, coloring properties, chargeability and the like may be shown at their best.

However, such layers are merely laminated, the outermost surface layer or the intermediate layer disposed inside the outermost surface layer is apt to be separated or abraded by the mixing and stirring or the friction with carriers within the developing device during the operation.

That is to say, once the surface of toner is broken or abraded, the intermediate layer, which is different in chargeability from the surface layer, is bared partially, and as result, the toner exhibits the poor chargeability and the formed image exhibits much fogs on the ground.

In particular, if the coloring agents are exposed on the surface of the toner particles on account of the separation of the outermost surface layer, the chargeability is greatly changed depending upon the kind and/or the exposed amount of the coloring agent. As a result, the distribution of the charged quantity of toner is widened, whereby problems occur in flying and fogs of toner.

Further, the particles which are produced by separation or abrasion influence toner or carrier each other, resulting in adverse influences on chargeability of developer and quality of copied images.

The particles peeled off from the coating layers of toner are very small, and adhered firmly to a photosensitive member. As the adhered particles are difficult to remove with a cleaner, there arise such problems as cleaning failure, filming phenomenon and the like. When fine particles (in particular, 5 μm or less in particle size) increase, the flowability of a developer decreases greatly, with the result in insufficient stirring, aggregation of developer and decrease of developing efficiency.

With respect to layered toner, Japanese Patent Laid-Open No. 61-275767 discloses layered toner formed of a layer containing magnetic body and/or coloring agent on core parricide in a wet process and a capsule layer prepared by polymerizing one or more monomers selected from fluorine-containing monomers, amino-containing monomers and nitro-containing monomers. Japanese Patent Published No. 59-38583 discloses toner with coating layers formed on core particles in a wet process in which the coating layers are prepared with fine particles obtained by emulsion polymerization. Japanese Patent Laid-Open No. 62-226162 discloses toner in which fine resin particles are adhered to surfaces of colored thermoplastic resin in a wet process followed by heat treatment.

Both of the techniques above mentioned utilize the dependence of electrical properties on surface portions of toner to aim to stabilize chargeability of toner by adjusting physical properties of resin of the surface layer or shapes of the surface layers. But, these resin layers adhered to surfaces of core particles by the wet process are formed of fine resin particles fixed on core particles with the shapes of particles kept as they are. Accordingly, the resin layers do not cover the surfaces of core particles completely (that is, the layers are not dense.). Therefore, toner is influenced adversely by coloring agents, magnetic parries and the like contained in core particles, with the result that the toner particles are not charged stably. In particular, toner is preserved or used under severe conditions, a resin component of the core goes outside from between fine resin particles. The bared resin influences charging stability, much more adversely, and also brings about such a problem as aggregation of toner particles.

SUMMARY OF THE INVENTION

It is an object of the present invention to solve the problems, such as the generation of poorly chargeable toner and fogs on the ground, resulting from the intermediate layer (or core particles) exposed in the case where the outermost surface layer or the intermediate layer disposed inside the outermost surface layer is separated or abraded by the mixing and stirring or the friction with carriers within the developing device during the operation, whereby providing layered toner capable of forming copied images of high quality and superior in durability and stability and exhibiting little fogs and the like.

DETAILED DESCRIPTION OF THE INVENTION

Figure 1:
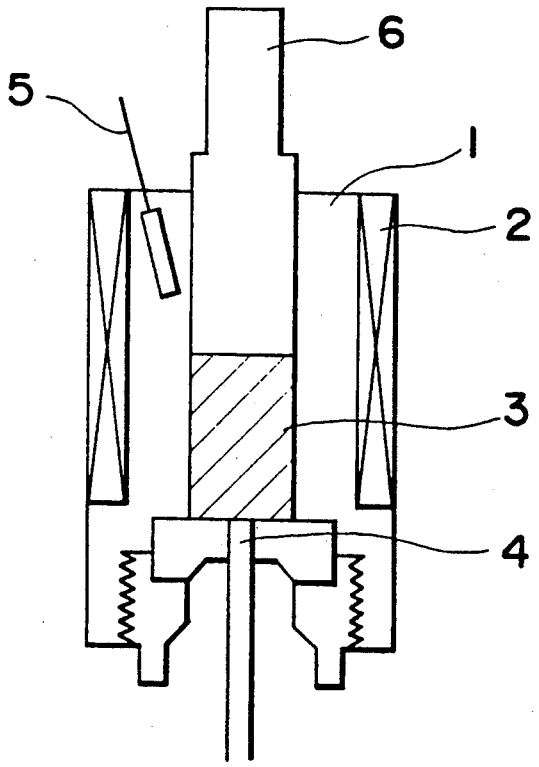
FIG. 1 is a schematic sectional view of an apparatus for measuring a viscosity of resin.

The toner for use in the development of electrostatic latent images according to the present invention comprises three layers, that is core particles, an intermediate layer coating said core particle and an outermost surface layer coating said intermediate layer.

A first embodiment of the present invention relates to a positively chargeable toner for use in the development of the electrostatic latent image having a constitution that the intermediate layer and the outermost surface layer are laminated on the core particles in this order, said core particles, intermediate layer and outermost surface layer being formed of styrene-acrylic copolymer resins, a content of styrenic monomer in said styrene-acrylic copolymer resins, of which the core particles are formed, being larger than that in said styrene-acrylic copolymer resins, of which the intermediate layer is formed, and that in said styrene-acrylic copolymer resins, of which the intermediate layer is formed, being larger than that in said styrene-acrylic copolymer resins, of which the outermost surface layer is formed.

In addition, a second embodiment of the present invention relates to a negatively chargeable toner for use in the development of electrostatic latent images having a constitution that the intermediate layer and the outermost surface layer are laminated on the core particles in this order, said core particles, intermediate layer and outermost surface layer being formed of styrene-acrylic copolymer resins, a content of styrenic monomer in said styrene-acrylic copolymer resins, of which core particles are formed, being smaller than that in said styrene-acrylic copolymer resins, of which the intermediate layer is formed, and that in said styrene-acrylic copolymer resins, of which the intermediate layer is formed, being smaller than that in said styrene-acrylic copolymer resins, of which the outermost surface layer is formed.

In the first and second embodiments, the core particles are formed of styrene-acrylic copolymer resins. The core particles play a role mainly in fixing the toner. From such a view point, it is sufficient to select the styrene-acrylic copolymer resins which have been usually used. In such a case, a ratio of styrenic monomer contained in the styrene-acrylic copolymer resins, of which the core particles are formed, is 30 to 90%, preferably 60 to 90% , still more preferably 65 to 80%.

In the toner for use in the development of electrostatic latent images according to the present invention, the core particles as above described are coated. Since this coated layer is further coated as mentioned later, a layer coating the core particles is referred to as "intermediate layer" in the present specification.

The intermediate layer is formed of the same styrene-acrylic copolymer resins as the core particles but the ratio of constituent monomers in the copolymer resins is varied depending upon the polarity (+ or −) of the chargeability of the toner, which is finally aimed, during the operation. In the case where the final toner is used as the one positively chargeable, the ratio of the styrenic monomer in the copolymer resins, of which the intermediate layer is formed, is smaller than that in the copolymer resins of which the core particles are formed. In the case where the toner which is finally obtained, is used as the one negatively chargeable, the ratio of the styrenic monomer in the copolymer resins of which the intermediate layer is formed is larger than that in the copolymer resins of which the core particles are formed. Provided that the ratio of the styrenic monomer in the resins, of which the core particles are formed, is So (%) and the ratio of the styrenic monomer in the resins, of which the intermediate layer is formed, is $S_1$ (%), it is desired that an absolute value of a difference between $S_0$ and $S_1$ ($|S_0-S_1|$), in which it is the reason why the value of ($S_0-S_1$) is expressed by the absolute value that a negative value of ($S_0-S_1$) in the second embodiment is made the positive value, is 10% or more, preferably 20% or more, still more preferably 30% or more.

The above described constitution of the intermediate layer effects the easy formation of uniform intermediate layers, the adhesion of the intermediate layer to the core particles, the separation resistance of said layers and the preparation of resultant toner which is more suitable for positive or negative chargeability. In the case where the core particles contain coloring agents, the intermediate layer can completely cover the coloring agents exposed on the surface of the core particles to prevent a bad influence of the coloring agents upon the charging characteristics of the toner.

In the first and second embodiments of the present invention, the difference between the content of the styrenic monomer in the resins, of which the core particles are formed, and that in the resins, of which the intermediate layer is formed, produces a difference of chargeable level between both copolymer resins, so that the fine resin particles can be uniformly adhered to the surface of the core particles, because the copolymer resins containing the styrenic monomer in smaller ratio exhibit the larger positive chargeability than that of the copolymer containing the styrenic monomer in larger ratio.

In the toner for use in the development of electrostatic latent images according to the present invention, the intermediate layer is further coated. Since this coating layer is positioned at the outermost side, the layer coating the intermediate layer is referred to as "outermost surface layer" in the present specification.

According to the first and second embodiments, the outermost surface layer is formed of the same styrene-acrylic copolymer resins as the core particles and the intermediate layer but the ratio of the styrenic monomer in the resins, of which the outermost surface layer is formed, is smaller than that in the resins, of which the intermediate layer is formed, in the case where the final toner is used as the one positively chargeable. In the case where the final toner is used as the one negatively chargeable, the ratio of the styrenic monomer in the resins, of which the outermost surface layer is formed, is larger than that in the resins of which the intermediate layer is formed.

Provided that the ratio of the styrenic monomer in the resins, of which the intermediate layer, is $S_1$ (%) and that in the resins, of which the outermost surface layer is formed, is $S_2$ (%), it is desired that an absolute value $|S_1-S_2|$ is 5% or more, preferably 10% or more, still more preferably 20% or more. When the preparation of positively chargeable toner is aimed, the outermost surface layer may be formed of the resins comprising merely the acrylic monomers without comprising styrenic monomers.

In addition, if the respective layers are formed of the styrene-acrylic copolymer resins so that the above described value of $|S_1-S_2|$ may be smaller than an absolute value $|S_0-S_1|$ of the difference between the ratio $S_0$ (%) of the styrenic monomer in the resins, of which the core particles are formed, and that $S_1$ (%) in the resins, of which the intermediate layer is formed, and the value of $|S_0-S_1|$ may be increased as far as possible within the preferable range, the chargeability of the toner is still more improved.

The outermost surface layer is satisfactorily adhered to the intermediate layer and resistant to separation. Moreover, the outermost surface layer is suitable to the chargeability to be applied so that the durability can be improved and the uniform chargeability can be given for a long time to reduce fogs and the like on the copied image.

Furthermore, if the outermost surface layer is formed in the above described manner, the chargeability, the developing property, the heat resistance and the like can be determined by the properties of the outermost surface layer, with being hardly influenced by the intermediate layer or the core particles existing inside. Accordingly, even though the kind, quantity and the like of the coloring agents contained in the core particles or the intermediate layer are varied, the stable and uniform chargeability can be given to the respective toner particles.

A third embodiment of the present invention relates to a negatively chargeable layered toner for use in the development of an electrostatic latent image comprising core particles and an intermediate layer and an outermost surface layer laminated on said core particles in this order, in which the core particles, the intermediate layer and the outermost surface layer are formed of styrene-acrylic copolymer resins, a content of styrenic monomers in said styrene-acrylic copolymer resins, of which the core particles are formed, being larger than that in said styrene-acrylic copolymer resins, of which the intermediate layer is formed, said content of styrenic monomers in the resins, of which the intermediate layer is formed, being smaller than that in the resins, of which the outermost surface layer is formed, the core particles or the intermediate layer containing coloring agents, and the layer containing said coloring agents being formed of the styrene-acrylic resins having the lowest viscosity among the resins of which the core particles, the intermediate layer and the outermost surface layer are formed.

Besides, a fourth embodiment of the present invention relates to a positively chargeable layered toner for use in the development of an electrostatic latent image comprising core particles and an intermediate layer and an outermost surface layer laminated on said core particles in this order, in which the core particles, the intermediate layer and the outermost surface layer are formed of styrene-acrylic copolymer resins, a content of styrenic monomers in said styrene-acrylic copolymer resins, of which the core particles are formed, being smaller than that in said styrene-acrylic copolymer resins, of which the intermediate layer is formed, said content of the styrenic monomers in said resins, of which the intermediate layer is formed, being larger than that in said resins, of which the outermost surface layer is formed, the core particles or the intermediate layer containing coloring agents, and the layer containing said coloring agents being formed of the styrene-acrylic resins having the lowest viscosity among the resins of which the core particles, the intermediate layer and the outermost surface layer are formed.

In the third and fourth embodiments, the ratio of the styrenic monomers contained in the styrene-acrylic copolymer resins, of which the core particles are formed, is 30 to 90%, preferably 60 to 90%, still more preferably 65 to 80%.

The intermediate layer is formed of the same styrene-acrylic copolymer resins as the core particles but the ratio of the constituent monomers in the copolymer resins is varied depending upon the polarity of the chargeability of the toner, which is finally obtained, aimed. In the case where the final toner is used as the positively chargeable one, the ratio of the styrene monomers in the resins, of which the intermediate layer is formed, is larger than that in the resins of which the core particles are formed. In the case where the toner, which is finally obtained, is used as negatively chargeable one, the ratio of the styrenic monomers in the resins, of which the intermediate layer is formed, is smaller than that in the resins of which the core particles are formed. Provided that the ratio of the styrenic monomers in the resins, of which the core particles are formed, is $S_0$ (%) and that in the resins, of which the intermediate layer is formed, is $S_1$ (%), it is desired that an absolute value of a difference between $S_0$ and $S_1$ ($|S_0-S_1|$), in which it is the reason why the value of ($S_0-S_1$) is expressed by the absolute value that a negative value of ($S_0-S_1$) is intended to express as the positive value when the ratio of the styrenic monomers is increased, is 10% or more, preferably 15% or more, still more preferably 20% or more.

Since the ratio of the styrenic monomers in the resins, of which the core particles are formed, is 30 to 90% as above described, when it is intended to form the intermediate layer at a more preferable difference in content of styrenic monomers, the core particles are formed of the resins having the reduced content of styrenic monomers correspondingly.

In the third and fourth embodiments of the present invention, the difference between the content of the styrenic monomer in the resins, of which the core particles are formed, and that in the resins, of which the intermediate layer is formed, produces a difference of chargeable level between both copolymer resins, so that the fine resin particles can be uniformly adhered to the surface of the core particles, because the copolymer resins containing the styrenic monomer in smaller ratio exhibit the larger positive chargeability than that of the copolymer containing the styrenic monomer in larger ratio.

According to the present invention, coloring agents are contained in the core particles or the intermediate layer. In the third and fourth embodiments of the present invention, the layer containing the coloring agents is formed of the resin having the lowest viscosity among the core particles, the intermediate layer and the outermost surface layer. Thus, the dispersion of the coloring agents in the resin can be improved and the image-concentration can be increased In particular, it is effective in the case where the coloring agents are contained in the intermediate layer. According to the present invention, the intermediate layer can be formed also of resins having a softening point lower than that of the core particles.

In the present invention, the viscosity is the $T_f$ value which is below described. But, in the case where the coloring agents are contained, said $T_f$ value of the styrene-acrylic copolymer resins is 60° to 150° C., preferably 80° to 120° C., still more preferably 90° to 110° C. If the $T_f$ value exceeds 150° C., the dispersion of the coloring agents into the resins is deteriorated, the copied image being wanting in hiding force, and the adhesion to the outermost surface layer being deteriorated. If the $T_f$ value is lower than 60° C., it becomes to produce the fine resin particles and they are apt to aggregate, whereby it becomes difficult to form the uniform intermediate layer.

In more detail, in the case where the coloring agents are contained in the core particles, in view of the uniform layer-formation on and the adhesion to the core materials, the intermediate layer is formed of the resins having the $T_f$ value of about 90° to 120° C. And, in view of the uniform layer-formation on and the adhesion to the intermediate layer, the outermost surface is formed of the resins having the $T_f$ value of about 100° to 150° C.

In the case where the coloring agents are contained in the intermediate layer, in view of the fixation, the core particles are formed of the resins having the $T_f$ value of about 80° to 110° C. And, in view of the uniform layer-formation on and the adhesion to the intermediate layer, the outermost surface layer is formed of the resins having the $T_f$ value of about 100° to 150° C.

In addition, the $T_f$ value according to the present invention is measured by the following method. This method is described with reference to FIG. 1. That is to say, a sample (3) of 1.5 g is put in a cylinder (1) (having a sectional area of 1 $cm^2$) inside a heater (2) to be heated at a temperature-rise rate of 3° C./min. A piston (6) is inserted into the cylinder to apply the load of 30 $Kg/cm^2$, whereby flowing out the sample through a nozzle (4) (having a diameter of 1 mm). A quantity of the sample flown out, a descending distance of the piston and a temperature are read. The temperature is detected by a temperature detector (5).

Such the measurement can be concretely conducted by the use of a descending type flow tester CFT-500 (made by Shimazu K.K.).

The quantity of the sample flown out at the respective temperature was measured and converted into the viscosity at the respective temperatures by the following equation:

$$\text{Viscosity}(\eta)=(\pi\cdot R^4\cdot P)/(8\cdot L\cdot Q)\ \text{(poise)}$$

wherein

R: a radius of the nozzle (0.5 cm);

P: a load (30 $kg/cm^2$ $3.059\times10^{-4}$ Pa);

L: a length of the nozzle (0.1 cm);

Q: flow rate (ml/sec);

wherein $Q=(1.5\cdot S)/t$;

S: a sectional area of the cylinder (1 $cm^2$);

t: a time (sec) required for descending the resin by 1.5 cm.

The temperature, at which the viscosity obtained by the above described method amounts to $10^6$ poise, is defined as the $T_f$ value.

According to the third and fourth embodiments of the present invention, the outermost surface layer is formed of the same styrene-acrylic copolymer resins as the core particles and the intermediate layer but in the case where the final toner is used as the positively chargeable one, the outermost surface layer is formed of the resins having the ratio of the styrenic monomers smaller than that in the resins of which the intermediate layer is formed. It is desirable that the difference in ratio of the styrenic monomers is 10% or more, preferably 15% or more, still more preferably increased as far as possible. If the difference is smaller than 10%, it is difficult to make the final tone suitable for positive chargeability and to form a uniform layer In the case where the final toner is used the one negatively chargeable, the outermost surface layer is formed of the resins having the ratio of the styrenic monomers larger than that in the resins of which the intermediate layer is formed. It is desirable that the difference in ratio of the styrenic monomers is 10% or more, preferably 15% or more, still ore preferably increased as far as possible. If the difference is smaller than 10%, it is difficult to make the final tone suitable for negative chargeability and to form a uniform layer. When it is intended to prepare the negatively chargeable toner, the outermost surface layer may be formed of the resins comprising merely the styrenic monomers.

A fifth embodiment of the present invention relates to a positively chargeable layered toner for use in the development of an electrostatic latent image comprising core particles and an intermediate layer and an outermost surface layer laminated on said core particles in this order, in which said core particles are formed of polyester resins, said intermediate layer and said outermost surface layer being formed of styrene-acrylic copolymer resins, and a ratio of styrenic monomers in said styrene-acrylic copolymer resins, of which the intermediate layer is formed, being larger than that in the styrene-acrylic copolymer resins of which the outermost surface layer is formed.

According to the fifth embodiment of the present invention, the core particles play a role mainly in fixing the toner. It is sufficient to select or prepare the polyester resins in view of such the point. Also the transparent polyester resins can be prepared and thus also the transparent color toner can be obtained according to the following description. Also in that case, a color (full-color) copied image can be formed without deteriorating the effects of the present invention.

The intermediate layer is formed of the styrene-acrylic copolymer resins but a ratio (hereinafter referred to as "$S_1$") of styrenic monomers in the styrene-acrylic copolymer resins, of which the intermediate layer is formed, is 10 to 100%, preferably 20 to 100%, still more preferably 50 to 100%. The styrene-acrylic resins for forming the intermediate layers are selected from the ones having the ratio ($S_1$) of at least 10% taking the formation of the outermost surface layer, which will be mentioned later, into consideration.

The outermost surface layer is formed of the same styrene-acrylic copolymer resins as the intermediate layer but the ratio of the styrenic monomers in the styrene-acrylic copolymer resins, of which the outermost surface layer is formed, is smaller than that in the styrene-acrylic copolymer resins of which the intermediate layer is formed.

Provided that the ratio of the styrenic monomers in the resins, of which the intermediate layer is formed, is $S_1$ (%) and that in the resins of which the outermost surface layer is formed, is $S_2$ (%), it is desirable that the difference ($S_1$–$S_2$) is 5% or more preferably 10% or more, still more preferably 20% or more. The outermost surface layer may be formed of the resins comprising merely acrylic monomers without comprising the styrenic monomers. The toner obtained by forming the outermost surface layer of the above described resins is more suitable for the positive chargeability.

The outermost surface layer is sufficiently adhered to the intermediate layer and difficult to be separated from the intermediate layer. Moreover, the outermost surface layer is fitted for the chargeability to be applied so that the durability is improved and the uniform chargeability can be given for a long time. Thus, the obtained copied image is superior and hardly exhibits fogs and the like. Even though the outermost surface layer is separated partially, the intermediate layer disposed below the outermost surface layer is formed of the same styrene-acrylic copolymer resins as the outermost surface layer, so that a great effect to such an extent that the polyester resins, of which the core particles are formed, are exposed is not brought about.

A sixth embodiment of the present invention relates to a negatively chargeable layered toner for use in the development of an electrostatic latent image comprising core particles and an intermediate layer and an outermost surface laminated on said core particles in this order, in which said core particles are formed of polyester resins, said intermediate layer and said outermost surface layer being formed of styrene-acrylic copolymer resins, and a content of styrenic monomers in said styrene-acrylic copolymer resins, of which the outermost surface layer is formed, being larger than that in the styrene-acrylic copolymer resins of which the intermediate layer is formed.

The intermediate layer is formed of the acrylic or styrene-acrylic copolymer resins but a ratio (hereinafter referred to as "$S_1$") of styrenic monomers in the styrene-acrylic copolymer resins, of which said intermediate layer is formed, is 0 to 90%, preferably 0 to 80%, still more preferably 0 to 50%. If the ratio ($S_1$) of the styrenic monomers exceeds 90%, the uniform layer-formation of the outermost surface layer is deteriorated.

The outermost surface layer is formed of the same styrene-acrylic copolymer resins as the intermediate layer but the ratio of the styrenic monomers in the styrene-acrylic copolymer resins, of which the outermost surface layer is formed, is larger than that in the styrene-acrylic copolymer resins of which the intermediate layer is formed.

Provided that the ratio of the styrenic monomers in the resins, of which the intermediate layer is formed, is $S_1$ (%) and that in the styrene-acrylic copolymer resins, of which the outermost surface layer is formed, is $S_2$ (%), it is desirable that the difference ($S_2$–$S_1$) is 5% or more, preferably 10% or more, still more preferably 20% or more. The outermost surface layer may be formed of the resins comprising merely the styrenic monomers. The toner, which is obtained by forming the outermost surface layer of the above described resins, becomes more suitable for the negative chargeability.

The core particles, intermediate layer and outermost surface layer of the toner for use in the development of an electrostatic latent image according to the present invention are in more detail described.

Styrene monomers used as one monomer component of polystyrene acrylic copolymers are exemplified by styrene, o-methylstyrene, m-methylstyrene, p-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene, p-chlorostyrene, 3,4-dichlorostyrene, and a derivative thereof. Among these styrene monomers, styrene is most preferable.

Acrylic monomers used as the other monomer component of polystyrene acrylic copolymers of core particles are exemplified by acrylic acids or derivatives thereof, such as acrylic acid, methylacrylate, ethylacrylate, n-butylacrylate, isobutylacrylate, propylacrylate, n-octylacrylate, dodecylacrylate, 2-ethylhexylacrylate, stearylacrylate, 2-chloroethylacrylate, phenylacrylate, α-chloroethyleacrylate, a derivative thereof and the like, methacrylic acids or a derivative thereof, such as methacrylic acid, methylmethacrylate, ethylmethacrylate, propylmethacrylate, n-butylmethacrylate, isobutylmethacrylate, propylmethacrylate, n-octylmethacrylate, dodecylmethacrylate, 2-ethylhexylmethacrylate, stearylmethacrylate, phenylmethacrylate, dimethylaminoethylmethacrylate, diethylaminoethylmethacrylate, a derivative thereof and the like, acrylonitrile, methacrylonitrile, a derivative of (metha)acrylic acid such as acrylamide and the like.

With respect to resin particles used as core particles, any resin particles may be available that are prepared by known methods, for example, by a pulverizing method, granulation methods such as emulsion polymerization, suspension polymerization and the like, wet granulation methods such as a suspension method, a spray-drying method and the like. However, because the shape and size-distribution of core particles may almost decide the shape and size distribution of resultant toner and influence on flowability, chargeability or the like of toner particles, the desirable resin particles used as core particles are as spherical as possible and have narrow distribution of particle size. Such resin particles may be prepared desirably by granulation polymerization methods such as emulsion polymerization, suspension polymerization and the like. In particular, seed polymerization method, one of granulation polymerization methods, makes it easy to prepare resin particles with high spherical degree and narrow distribution of particle size, and that to control polymerization degree. Therefore, the seed polymerization method may provide toner particles extremely suitable for the present invention.

The seed polymerization method is described in, for example, Japanese Patent Published No. 57-24369, in which part of polymerizable monomer and a polymerization initiator are added into an aqueous solvent or an aqueous solvent containing an emulsifying agent, stirred and emulsified, and then the residual part of the polymerizable monomer are added gradually to the obtained emulsion drop by drop to obtain fine particles, and then polymerization is carried out in droplets of polymerizable monomers with the fine particles as a polymerizing center.

Core particles may include a coloring agent, or a coating layer containing a coloring agent may be formed on the surface of core particles. In granulation polymerization, a coloring agent may be dissolved or dispersed in polymerizable monomer to prepare resin particles containing the coloring agent. However, it is desirable that coloring agents are not added in seed polymerization process in order to form uniform resin particles.

In the case where polyester resins are applied as a main component of core particles, the polyesters are synthesized by reacting polyol components with dicarboxylic acid. Polyol components are exemplified by ethylene glycol, triethylene glycol, 1,2-propylene glycol, 1,3-propylene glycol, 1,4-butanediol, 1,4-bis(hydroxymethyl)cyclohexane, bisphenol A, hydrogenated bisphenol A, polyoxyethylenated bisphenol A and the like.

Dicarboxylic acids are exemplified by maleic acid, fumaric acid, mesaconic acid, citraconic acid, itaconic glutaconic acid, phthalic acid, isophthalic acid, terephthalic acid, succinic acid, adipic acid, sebacic acid, malonic acid, 1,2,4-benzene tricarboxylic acid, 1,2,5-benzene tricarboxylic acid, 1,2,4-cyclohexane tricarboxylic acid, 1,2,5-cyclohexane tricarboxylic acid, 1,2,4-butane tricarboxylic acid, 1,3-dicarboxy-2-methyl-2-methylcarboxypropane, tetra(methylcarboxy)methane and the like.

Core particles are prepared so that mean particle size may be 1–20 μm, preferably 3–15 μm more preferably 5–10 μm.

Further, resin particles used as core particles are the ones having coefficient of variation of particle size of less than 10%, preferably less than 8%. Moreover, from the view point that resin particles are preferably as spherical as possible to achieve high spherical degree of layered toner of the present invention, core particles are prepared so that shape coefficient (SFl) is 120 or less, preferably 115 or less.

Coefficient of variation in the present invention means variation measures (%) obtained as follows; a photograph is taken with a scanning electron microscope, one hundred of particles are taken at random for measurement of particle sizes to obtain a standard deviation value The standard deviation value is represented by the square root of the total values of the square of the difference between the mean particle size and each particle size represented by the following formula;

$$\sigma = \sqrt{\frac{(x_1 - \overline{x})^2 + (x_2 - \overline{x})^2 + \ldots\ldots + (xn - \overline{x})^2}{n - 1}} = \sqrt{\frac{1}{n-1}\left[\Sigma xi^2 - \frac{(\Sigma xi)^2}{n}\right]}$$

Wherein $X_1$, $X_2$—, $X_n$ represent respective particle sizes of sample particles, $\overline{X}$ represents the mean value of the n particle sizes.

The standard deviation value ($\sigma$) is divided by the mean particle size ($\overline{X}$), and one hundred times the deviated value is the coefficient of variation (%).

$$\text{coefficient of variation} = \frac{\sqrt{\frac{1}{n-1}\left[\Sigma xi^2 - \frac{(\Sigma xi)^2}{n}\right]}}{x} \times 100$$

Shape coefficient (SF1) in the present invention is used as a parameter which shows the difference between long diameter and short diameter of a particle (distortability). SF1 is one of standards to show spherical degree of particles.

*SF*1 is defined as;

$$SF1 = \frac{(\text{maximum length})^2}{(\text{area})} \times \frac{(\pi)}{4} \times 100$$

wherein "area" means an average value of the projected area of a particle and "maximum length" means an average value of the longest length in the projected image of a particle.

Shape coefficient in the invention is expressed by the mean value measured with Image Analyzer (LUZEX 5000, made by Nihon Regulator K.K.), but, the value is not limited to the one measured by the above Image Analyzer, because the value does not depend generally on a kind of measuring apparatus.

The value of SFI becomes near to 100 as the shape is closer to circle.

The above described constitution of the intermediate layer leads to the possibility of the uniform formation of the intermediate layer, the enhancement of the adhesion of the intermediate layer to the core particles, the difficult separation of the intermediate layer and the better suitability of the finally obtained toner for the positive or negative chargeability. In the case where the coloring agents are contained in the core particles, the coloring agents exposed on the surface of the core particles can be completely coated with the intermediate layer to prevent had influences by the coloring agents upon the charging characteristics of the toner.

A layer-thickness of the intermediate layer is almost determined by a size of resin particles used in the formation of the intermediate layer which will be mentioned later but it is sufficient that the layer-thickness of the intermediate layer is about 1/5 or less times a mean particle size of the core particles. The layer-thickness of the intermediate layer may be reduced as much as one likes so far as the bad influences by the exposure of the surface of the core particles can be prevented.

As to a method of forming the intermediate layer, a method, in which core particles and small particles (that is resin particles) having diameters smaller than those of said core particles, concretely about 1/5 or less of said core particles, are mechanically blended in a suitable ratio to uniformly adhere the small particles to circumferences of core particles by the action of the Van der Waals' force and the electrostatic force and then the small particles are softened by the local temperature-rise resulting from, for example, an impact force to form a film, is preferably used.

With such the method, the intermediate layer easily and substantially completely covering the outer surface of the core particles can be formed without substantially changing the shape and the distribution of particle size of the core particles even though a softening point of the thermoplastic resins of which the core particles are formed is lower than that of the resins of which the intermediate layer is formed.

Apparatus, which may be suitably used in said method of forming the intermediate layer, include the hybridization system (made by Nara Kikai Seisakusho K.K.) applying the impact force in high-speed air current method, the Angmill (made by Hosokawa Micron K.K.), the Mechanomill (made by Okada Seiko K.K.) and the like.

However, the method of forming the intermediate layer is not limited by the above described methods.

In addition, here the fine resin particles for use in the formation of the intermediate layer having the mean which the intermediate layer is formed, and the value of S0 particle size of 0.05 to 3 μm, preferably 0.1 to 1 *m, and the coefficient of variation of the distribution of particle sizes of 20% or less, preferably 15% or less, are used. Fine particles having the mean particle size smaller than 0.05 μm are difficult to produce. If the mean particle size is larger than 3 μm or the variation of coefficient is larger than 20%, it is difficult to coat the surface of the core particles.

The fine resin particles used for the formation of the intermediate layer can be prepared in the same manner as the method of producing the core particles and the conditions are suitably selected so that the resin particles may have the desired copolymerization monomer ratio and particle size.

Furthermore, a quantity of the resin particles used in the formation of the intermediate layer is 5 to 50 parts by weight, preferably 10 to 30 parts by weight, based on 100 parts by weight of the core particles. That is to say, if the quantity of the resins, of which the intermediate layer is formed, is less than 5 parts by weight, it is difficult to completely cover the core particles with the intermediate layer and the resins, of which the core particles are formed, are oozed out to aggregate the toner. In the case where the coloring agents are contained in the core particles, there is the possibility that the coloring agents are exposed on the surface of the toner particles to hinder the stabilized and uniform chargeability. On the other hand, if the quantity of the resins exceeds 50 parts by weight, the uniform intermediate layer can not be formed.

The intermediate layer may contain coloring agents. The method of forming the intermediate layer containing the coloring agents on the surface of the core particles is not specially limited. For example, merely the coloring agents can be adhered to the surface of the resin particles as the core particles by Van der Waals' force and the electrostatic force by a wet or dry method and then fixedly adhered to the core particles by the thermal or mechanical impact force and the like or the coloring agents may be fixedly adhered to the surface of the core particles together with the resin particles or the resin particles containing the coloring agents may be fixedly adhered to the surface of the core particles. Also in these cases, it is sufficient that the particle size is within the almost same range as that of the above described resin particles.

A coloring agent contained in toner for developing electrostatic latent images of the present invention is not given particular limitation and may be selected from various kinds of pigments and dyes of various colors. The coloring agent employed in the present invention is as follows;

For a yellow pigment, is available chrome yellow, zinc yellow, cadmium yellow, yellow oxide or the like;

For an orange pigment, is available chrome orange, molybdenum orange or the like;

For a red pigment, is available red iron oxide, cadmium red, red lead oxide, cadmium mercury sulfide or the like;

For a purple pigment, is available manganese violet, fast violet B, methyl violet lake or the like;

For a blue pigment, is available prussian blue, cobalt blue, alkali blue lake, victoria blue lake, phthalocyanine blue or the like;

For a green pigment, is available chrome green, chrome oxide or the like;

For a white pigment, is available zinc white, titanium oxide, antimony white, zinc sulfide or the like;

For black pigment, is available carbon black such as furnace combustion black, channel black, or acetylene black, alternately, activated carbon, unmagnetic ferrite or the like.

For an extender pigment, is available powdery barytes, barium carbonate, clay, silica, white carbon, talc, alumina white or the like.

In use thereof, one or more than two kinds of them may be mixed. In any case, the limitation is not particularly given to the pigments to the dyes, so far as they are pollution-free, and have high coloring power.

These coloring agents can be used singly or in combination. It is desirable that the coloring agents are used in a quantity of 1 to 20 parts by weight, preferably 1 to 10 parts by weight, based on 100 parts by weight of the resins contained in the toner particle. That is to say, there is the possibility that if the quantity of the coloring agents is larger than 20 parts by weight, the fixation of the toner is lowered and on the other hand, if the quantity of the coloring agents is less than 1 part by weight, the desired image-concentration can not be obtained.

The outermost surface layer according to the present invention exhibits the superior adhesion to the intermediate layer and the resistance to separation, the intermediate layer. Moreover, the outermost surface layer is fit to the chargeability to be used, so that the durability can be improved and thus the obtained copied image hardly exhibits fogs and the like.

In addition, if the outermost surface layer is formed in such a manner, the chargeability, the developing property, the heat resistance and the like can be determined by the constitution of the outermost surface layer almost regardless of the constitution of the intermediate layer or the core particle, which are disposed inside the outermost surface layer, and thus, even though the kind, quantity and the like of the coloring agents contained in the core particles or the intermediate layer are changed, the stabilized and uniform chargeability can be given to the respective toner particles.

As to a method of forming the outermost surface layer, a method, in which resin particles containing styrene in the desired quantity are used and the outermost surface layer is formed in the same manner as the intermediate layer, may be used. Said outermost surface layer may further contains charge controlling agents if desired.

That is to say, a method, in which core particles with the intermediate layer and fine particles having particle sizes smaller than those of the core particles with the intermediate layer, concretely about 1/5 or less of the size of the core particles with the intermediate layer (that is, fine resin particles, charge controlling agent particles, if desired, or resin particles containing charge controlling agents) are mechanically blended in a suitable ratio to uniformly adhere said fine particles to a circumference of the intermediate layer by the action of Van der Waals' force and the electrostatic force and then said resin particles are softened by the local temperature-rise resulting from, for example, an impact force to form a layer, is preferably used. The difference between the intermediate layer and the outermost surface layer in content of styrenic monomer leads to the difference between the two in charging level, whereby the resin particles can be uniformly adhered to the surface of the intermediate layer. Furthermore, here the resin particles for use in the formation of the outermost surface layer having a mean particle size of 0.05 to 3 μm, preferably 0.1 to 1 μm, and a coefficient of variation of the distribution of particle size of 20% or less, preferably 15% or less, are used. Particles having the mean particle size less than 0.05 μm are difficult to produce. If the mean particle size is larger than 3 μm or the coefficient of variation is larger than 20%, it is difficult to form an outermost surface layer covering the intermediate layer. According to such a method, the outermost surface layer easily and substantially completely covering the surface of the intermediate layer without substantially changing the shape and distribution of particle size of said core particles with the intermediate layer even though a softening point of the resins, of which the outermost surface layer is formed, is higher than that of the resins of which the intermediate layer is formed. Furthermore, the surface shape and properties, such as flatness and surface roughness, of the toner particles obtained in the above described manner can be changed by selecting the composition and physical properties (particle size, thermal characteristics, gel component and the like) of the core particles and the particles for the formation of the outermost surface layer, and further suitably selecting the treatment conditions. As to the shape of the toner particles, the spherical shape having a very small unevenness on a surface thereof is desirable in view of the characteristics, such as fluidity, cleaning property and chargeability, of the toner particles. Apparatus, which can be suitably used in such a method, include the hybridization system applying the impact force in high-speed air current method (made by Nara Kikai Seisakusho K.K.), the Angmill (made by Hosokawa Micron K.K.), the Mechanomill (made by Okada Seiko K.K.) and the like.

However, the method of forming the resin layer is not limited by the above described methods at all.

A positively chargeable agent is exemplified by Nigrosine Base EX (made by Orient Kagaku Kogyo K.K.), Quaternary Ammonium Salt P-51 (made by Orient Kagaku Kogyo K.K.), Nigrosine Bontron N-01 (made by Orient Kagaku Kogyo K.K.), Sudan Chief Schwalts BB (Solvent Black 3: Color Index 26150), Fett Schwaltz HBN (C.I. No. 26150), Brilliant Spirit Schwartz TN (made by Farben Fabriken Bayer K.K.), Zabon Schwalts X (made by Farwerke Hext K.K.), alkoxylated amine, alkylamide, chelate pigment of molybdic acid or the like.

A negatively chargeable agent is exemplified by Oil Black (Color Index 26150), Oil Black BY (made by Orient Kagaku Kogyo K.K.), Bontrona S-22 (made by Orient Kagaku Kogyo K.K.), Metal complex of salicylic acid E-81 (made by Orient Kagaku Kogyo K.K.), thioindigo pigments, sulfonylamine-derivatives of Copper phthalocyanine, Spilon Black TRH (made by Hododani Kagaku Kogyo K.K.), zinc metal complex E-84 (made by Orient Kagaku Kogyo K.K.), Bontron S-34 (made by Orient Kagaku Kogyo K.K.), Nigrosine SO (made by Orient Kagaku Kogyo K.K.), Seleschwaltz (R)G(Farben Fabriken Bayer K.K.), Chromogen Schwaltz ETOO (C.I. No. 14645), Azo Oil Black (R) (made by National aniline K.K.)

These charge controlling agents may be used singly or in combination but their quantity added in the outermost surface layer is 0.1 to 10 parts by weight, preferably 0.5 to 5 parts by weight, based on 100 parts by weight of the resins of which the outermost surface layer is formed. That is to say, if the quantity of the charge controlling agents added is less than 0.1 part by weight, a quantity of the charge controlling agents existing on the surface of the toner particle is reduced, so that the toner is wanting in charging quantity. If it exceeds 10 parts by weight, there is the possibility that the charge controlling agents are separated from the coating resin layer to be spent on the surface of carriers or mixed in the developers, whereby the durability with respect to copy is deteriorated.

Also the following monomer component having nitrogen-containing polar functional groups or fluorine may be used as the acrylic monomer component, of which the outermost surface layer is formed, in addition to the above described ones.

If the outermost surface layer is formed of the resins into which such the polar groups are introduced, these resins themselves control the charge, so that the chargeability can be given to some extent without specially adding the charge controlling agents to the outermost surface layer.

Also homopolymers of the following monomer components may be used and the above described effects can be achieved also by using fine resin particles of such the polymers in the formation of the outermost surface layer.

The nitrogen containing polar functional group is useful for controlling positive charges, and the monomer containing the same is expressed by the following formula (I):

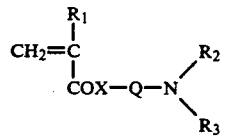

(I)

[in which $R_1$ is hydrogen or a methyl group, $R_2$ and $R_3$ are respectively hydrogen or an alkyl group having 1 to 20 carbon atoms, X is oxygen or nitrogen, and Q is an alkylene group or an allylene group.]

It is, however, not always necessary to add such the charge controlling agents or the above described polar group-containing resins to the toner for use in the development of an electrostatic latent image according to the present invention. If the developing sleeve, toner-regulating blade and the like in the single-component system and the carrier in the binary system having a sufficient difference from the toner in chargeability are used respectively, the toner can be charged as desired.

The toner for use in the development of an electrostatic latent image according to the present invention has the above described layered structure and exhibits the stabilized chargeability, fixing property, heat resistance and the like. It is further desirable that as to the shape characteristics of the finally obtained toner, the coefficient of variation of the particle size is less than 20%, preferably less than 10%, and the shape coefficient (SF1) is within the range of 110 to 140. That is to say, in the case where the toner particle has a remarkably high spherical degree and a narrow distribution of particle size, even when the particle size of toner is intended to be made small, the high fluidity and the stabilized and uniform chargeability characteristics can be given and the stabilized developing property can be given without producing problems such as fogs and the flying of the toner.

Example of the Production of Core Particles SI

| Ingredient | Parts by weight |
|---|---|
| Styrene-n-butyl methacrylate resin: (St;BMA = 7/3) (softening point: 108° C.; glass transition point: 52° C.: Mn = 12,000; Mw/Mn = 14; Tf: 100° C.) | 100 |
| Carbon black (MA#8 made by Mitsubishi Kasei Kogyo K.K.) | 5 |
| Low molecular polypropylene (Viscol 550P made by Sanyo Kasei Kogyo K.K.) | 4 |

The above described materials were sufficiently blended in a ball mill and then the resulting mixture was kneaded by means of a three-roll heated at 140° C. The kneaded mixture was left to stand to be cooled and then roughly pulverized in a feather mill followed by finely pulverizing in a jet mill. Subsequently, the resulting particles were subjected to air classification to obtain fine particles having a mean particle size of 11 μm. The obtained fine particles are called the core particles SI.

Example of the Production of Core Particles SII

Fine particles having a mean particle size of 11 μm were obtained in the same manner as in Example of the production of core particles SI excepting that carbon black was not added. The obtained fine particles are called the core particles SII.

Example of the Production of Core Particles SIII

| Ingredient | Parts by weight |
|---|---|
| Styrene | 70 |
| N-butyl methacrylate | 28 |
| Methacrylic acid | 2 |
| 2,2-azobis-(2,4-dimethylvaleronitrile) (first grade made by Wako Junyaku Kogyo K.K.) | 0.5 |

The above described materials were sufficiently blended in a sand stirrer to prepare a polymerizable composition This polymerizable composition was subjected to the polymerization reaction for 6 hours at 60° C. in an aqueous solution of Arabic rubber having a concentration of 3% by weight with stirring at 3,200 rpm in a stirrer—the T.K. AUTO HOMO MIXER (made by Tokushu Kika Kogyo K.K.) followed by rising the temperature up to 80° C. After the completion of the polymerization reaction, the reaction mixture was cooled and then washed 5 times with water followed by filtrating and drying to obtain spherical particles.

The obtained spherical particles were further subjected to the air classification to obtain the spherical particles having a mean particle size of 11 μm. These spherical particles are called the core particles SIII. In addition, these spherical particles have the softening point (Tm) of 110° C., the glass transition point (Tg) of 51° C. and the Tf of 120° C.

Example of the Production of Core Particles EI

Polyester resins (Mn=3,800; Mw/Mn=2.8; Tg=60° C.; Tf=110° C.) of 100 parts by weight were sufficiently blended in a ball mill and then kneaded by a three-roll heated at 140° C. The kneaded mixture was left to stand to be cooled and then roughly pulverized in a feather mill followed by finely pulverizing in a jet mill. Subsequently, the pulverized mixture was subjected to the air classification to obtain fine particles having a mean particle size of 11 μm. The obtained fine particles are called the core particles EI.

Example of the Production of Core Particles EII

Fine particles having a mean particle size of 11 μm were obtained in the same manner as in Example of the production of core particles EI by the use of a styrene-butyl acrylate-polyester graft copolymer (Mn=3,200; Mw/Mn=8.7; Tg=58° C.; Tf=105° C.). The obtained fine particles are called the core particles EII.

Example of the Production of Core Particles EIII

Fine particles having a mean particle size of 11 μm were obtained in the same manner as in Example of the production of core particles EI excepting that a polyester resin (Mn=5,600; Mw/Mn=25; Tg=67° C.; Tf=120° C.) was used in place of the polyester resin (Mn=3,800; Mw/Mn=2.8; Tg=60° C.; Tf=110° C.). The obtained fine particles are called the core particles EIII.

Example of the Production of Core Particles EIV

Polyester resins (Mn=3,800; Mw/Mn=2.8; Tg=60° C.; Tf=110° C.) of 100 parts by weight and carbon black MA#8 (made by Mitsubishi Kasei Kogyo K.K.) of 5 parts by weight were sufficiently blended in a ball mill and then kneaded by a three-roll heated at 140° C. The kneaded mixture was left to stand to be cooled and then roughly pulverized in a feather mill followed by finely pulverizing in a jet mill. Subsequently, the pulverized mixture was subjected to the air classification to obtain fine particles having a mean particle size of 11 μm. The obtained fine particles are called the core particles EIV.

Example of the Production of Core Particles EV

Fine particles having a mean particle size of 11 μm were obtained in the same manner as in Example of the production of core particles EIV excepting that a phthalocyanine pigment (C.I. 74160) of 3 parts by weight was used in place of carbon black. The obtained fine particles are called the core particles EV.

Example of the Production of Core Particles EVI

Fine particles having a mean particles size of 11 μm were obtained in the same manner as in Example of the production of core particles EIV by the use of a styrene-butyl acrylate-polyester graft copolymer (Mn=3,200; Mw/Mn=8.7; Tg=58° C.; Tf=105° C.) of 100 parts by weight and a phthalocyanine pigment (C.I. 74160) of 5 parts by weight. The obtained fine particles are called the core particles EVI.

Example of the Production of Core Particles EVII

Fine particles having a mean particle size of 11 μm were obtained in the same manner as in Example of the production of core particles EVI excepting that a polyester resin (Mn=5,600; Mw/Mn=25; Tg=67° C.; Tf=120° C.) was used in place of the styrene-butyl acrylate-polyester graft copolymer. The obtained fine particles are called the core particles EVII.

Method of Producing Fine Resin Particles

Monomer compositions shown in Table 1, polyvinyl alcohol saponified completely in ion-exchanged water, and sodium dodecylbenzene sulfonate as an emulsifying agent were added to reaction vessel provided with a stirrer, a condenser and a thermometer, then the obtained mixture were subjected to emulsion polymerization in the presence of sodium persulfate as a polymerization initiator with stirring and heating to form fine particles. Then, the resulting particles were coagulated by the use of calcium chloride in an aqueous dispersion system. Successively, the coagulated product was washed with water, filtrated and dried in vacuum, followed by pulverizing in a jet pulverizer to obtain fine resin particles A to L shown in Table 1.

The obtained fine particles were evaluated on the following items. The results are shown in Table 1.

Measurements of the Number Average Molecular Weight (Mn) and the Dispersion (Mw/Mn)

The number average molecular weight and the dispersion were measured by gel-permeation chromatography under the following conditions and shown by numeral values converted from a calibration curve prepared for standard polystyrene.

Detector: RID-300 type differential refractometer (made by Nihon Bunko Kogyo K.K.)
Column: A-80M×2
Temperature: 35° C.
Solvent: THF
Flow rate: 1.0 ml/min ponents contained in the resin are removed and then the insoluble components (Mr) are dried followed by measuring the weight [g]. The thus obtained % by weight of the insoluble components was adopted as the quantity of the gel components. The quantity of the gel components=(Mr/Ms)×100

TABLE 1

| Resin fine particles | Composition of monomers*1 | Particle size (μm) | Mn (× $10^4$) | Mw/Mn | Tf (°C.) | Tg (°C.) | Coefficient of variation | SF 1 | Quantity of gel component (%) |
|---|---|---|---|---|---|---|---|---|---|
| A | MMA/BA = 90/10 | 0.16 | 1.6 | 2.3 | 115 | 61 | 8 | 106 | 0 |
| B | ST/BA/2EHA = 50/30/20 | 0.16 | 1.4 | 2.5 | 90 | 63 | 6 | 105 | 0 |
| C | ST/BA = 90/10 | 0.15 | 1.5 | 2.5 | 90 | 62 | 7 | 104 | 0 |
| D | ST/MMA/BA = 50/30/20 | 0.16 | 1.5 | 2.3 | 105 | 58 | 7 | 106 | 0 |
| E | ST/BA = 30/70 | 0.16 | 1.6 | 2.3 | 110 | 64 | 7 | 104 | 0 |
| F | MMA/BA = 90/10 | 0.16 | 30.0 | 3.7 | 145 | 69 | 6 | 104 | 0 |
| G | ST/BA = 80/20 | 0.17 | 17.7 | 2.5 | 145 | 69 | 8 | 105 | 0 |
| H | ST = 100 | 0.16 | 14.8 | 2.4 | 148 | 71 | 7 | 106 | 0 |
| I | ST/BA = 70/30 | 0.16 | 18.5 | 2.3 | 150 | 78 | 8 | 106 | 0 |
| J | ST/BA = 70/30 | 0.15 | 8.0 | 2.5 | 130 | 69 | 7 | 105 | 0 |
| K | P-MMA = 100 | 0.15 | 27.3 | 5.4 | 220 | 120 | 7 | 106 | 0 |
| L | ST = 100 | 0.16 | 70.0 | 6.2 | 200 | 94 | 8 | 107 | 0 |
| M | ST/BNA = 20/80 | 0.15 | 25.0 | 4.9 | 155 | 70 | 8 | 108 | 0 |
| N | ST/MMA = 90/10 | 0.16 | 31.5 | 4.2 | 113 | 68 | 7 | 106 | 0 |
| O | ST/BA/2EHA = 40/40/20 | 0.16 | 1.3 | 2.4 | 95 | 63 | 6 | 105 | 0 |
| P | ST/BMA = 20/80 | 0.15 | 25.0 | 4.9 | 155 | 70 | 7 | 108 | 0 |
| Q | ST/MMA = 30/70 | 0.15 | 10.6 | 2.8 | 127 | 67 | 6 | 105 | 0 |

*MMA = methyl methacrylate; BA = butyl acrylate; ST = styrene; 2EHA = 2-ethyl-hexyl acrylate; P-MMA = polymethyl methacrylate.

Method of Measuring Value of Tf - Temperature at which Molten Viscosity Amounts to 106 poises in Flow Tester The molten viscosity was measured under the following measuring conditions in flow tester Model CFT-500 made by Shimazu Seisakusho K.K.

Nozzle: 1ϕ×1 mm
Temperature-rising rate: 3° C./min
Load: 20 kg/cm²
The temperature, at which the molten viscosity amounts to 106 poises, was adopted as the Tf value.

Glass Transition Temperature (Tg)

The glass transition temperature (Tg) was expressed by the value measured by means of the differential scanning calorimeter SSC/580 DSC20 made by Seiko Denshi Kogyo K.K.

Quantity of the Gel Components

The quantity of gel components is a quantity of resinous components which are not dissolved in toluene. The respective values shown in the present specification were obtained by the following measuring method. That is to say, a thermoplastic resin (Ms)[g]to be measured is extracted by means of Soxhlet extractor by the use of a glass filter (G-3). Thus the toluene-soluble com-

Production of Toner 1 to 33

Core particles and fine resin particles, which had been obtained in the above described manner, were blended together with coloring agents in the combinations and compositions shown in the following Table 2 and then the resulting mixtures were mixed and stirred at 1,500 rpm for 2 minutes in Henschel mixer having the capacity of 10 liters to adhere the fine resin particles and the coloring agents to the surface of the core particles.

Subsequently, the obtained mixtures of 150 g were put into Hybridizer NHS-1 (made by Nara Kikai Seisakusho K.K.) to be treated for 8 minutes at a peripheral speed of the blade of 78 m/sec and at room temperature, whereby forming uniform intermediate layers containing the coloring agents on the surface of the core particles.

Successively, the fine resin particles and charge controlling agents were treated in the same manner as in the formation of the intermediate layer excepting that they were blended in the combinations and compositions shown in the following Table 2 to form outermost surface layers containing the charge controlling agents, whereby obtaining the toner 1 to 33 shown in Table 2.

TABLE 2

| EXAMPLE / COMPARATIVE EXAMPLE Toner name | Formation of the intermediate layer: Core particles Sample name | Core particles Quantity (parts by weight) | Resin fine particle Sample name | Resin fine particle Quantity (parts by weight) | Coloring agent Sample name | Coloring agent Quantity (parts by weight) | Outermost surface: Resin fine particle Sample name | Resin fine particle Quantity (parts by weight) | Charge cont. agent Sample name | Charge cont. agent Quantity (parts by weight) | Physical prop. of the toner weight average particle size (μm) |
|---|---|---|---|---|---|---|---|---|---|---|---|
| EXAMPLE 1 1 | SI | 80 | P | 10 | — | — | K | 20 | *1 | 0.2 | 12.0 |
| EXAMPLE 2 2 | SI | 80 | E | 10 | — | — | F | 20 | *1 | 0.2 | 11.9 |
| EXAMPLE 3 3 | SII | 80 | 0 | 10 | *2 | 10 | Q | 20 | *1 | 0.2 | 12.0 |
| EXAMPLE 4 4 | SII | 80 | D | 10 | *2 | 10 | P | 20 | *1 | 0.2 | 12.1 |
| EXAMPLE 5 5 | SIII | 80 | G | 10 | *3 | 5 | L | 20 | *4 | 0.5 | 11.9 |

TABLE 2-continued

| EXAMPLE / COMPARATIVE EXAMPLE Toner name | Formation of the intermediate layer: Core particles Sample name | Core particles Quantity (parts by weight) | Resin fine particle Sample name | Resin fine particle Quantity (parts by weight) | Coloring agent Sample name | Coloring agent Quantity (parts by weight) | Outermost surface: Resin fine particle Sample name | Resin fine particle Quantity (parts by weight) | Charge cont. agent Sample name | Charge cont. agent Quantity (parts by weight) | Physical prop. of the toner weight average particle size (μm) |
|---|---|---|---|---|---|---|---|---|---|---|---|
| COMP.EX.1 6 | SI | 80 | I | 10 | — | — | J | 20 | *1 | 0.2 | 11.8 |
| COMP.EX.2 7 | SII | 80 | I | 10 | *2 | 10 | G | 20 | *1 | 0.2 | 12.0 |
| COMP.EX.3 8 | SII | 80 | L | 10 | *2 | 10 | H | 20 | *1 | 0.2 | 11.9 |
| EXAMPLE 6 9 | SI | 80 | E | 10 | — | — | H | 20 | *5 | 0.2 | 11.9 |
| EXAMPLE 7 10 | SI | 80 | D | 10 | — | — | G | 20 | *5 | 0.2 | 11.9 |
| EXAMPLE 8 11 | SII | 80 | B | 10 | *2 | 10 | H | 20 | *5 | 0.2 | 12.0 |
| EXAMPLE 9 12 | SII | 80 | C | 10 | *2 | 10 | F | 20 | *1 | 0.2 | 12.0 |
| EXAMPLE 10 13 | SIII | 80 | E | 10 | *3 | 5 | I | 20 | *4 | 0.2 | 12.0 |
| COMP.EX.4 14 | SI | 80 | I | 10 | — | — | J | 20 | *5 | 0.2 | 12.0 |
| COMP.EX.5 15 | SII | 80 | I | 10 | *2 | 10 | B | 20 | *5 | 0.2 | 11.8 |
| COMP.EX.6 16 | SII | 80 | D | 10 | *2 | 10 | B | 20 | *5 | 0.2 | 11.9 |
| EXAMPLE 11 17 | EI | 80 | C | 10 | *3 | 5 | F | 20 | *6 | 0.5 | 11.8 |
| EXAMPLE 12 18 | EI | 80 | B | 10 | *3 | 5 | K | 20 | *6 | 0.5 | 11.9 |
| EXAMPLE 13 19 | EII | 80 | C | 10 | *3 | 5 | M | 20 | *6 | 0.5 | 11.9 |
| EXAMPLE 14 20 | EII | 80 | D | 10 | *2 | 10 | F | 20 | *1 | 0.2 | 12.0 |
| EXAMPLE 15 21 | EIII | 80 | B | 10 | *3 | 5 | M | 20 | *6 | 0.5 | 12.0 |
| COMP.EX.7 22 | EI | 80 | N | 10 | *3 | 5 | C | 20 | *6 | 0.5 | 12.0 |
| COMP.EX.8 23 | EII | 80 | I | 10 | *3 | 5 | J | 20 | *6 | 0.5 | 11.9 |
| COMP.EX.9 24 | EIII | 80 | B | 10 | *2 | 10 | D | 20 | *1 | 0.2 | 11.9 |
| EXAMPLE 16 25 | EIV | 80 | A | 10 | — | — | G | 20 | *5 | 0.2 | 11.9 |
| EXAMPLE 17 26 | EIV | 80 | J | 10 | — | — | H | 20 | *5 | 0.2 | 11.8 |
| EXAMPLE 18 27 | EV | 80 | F | 10 | — | — | L | 20 | *4 | 0.2 | 11.9 |
| EXAMPLE 19 28 | EVI | 80 | M | 10 | — | — | L | 20 | *4 | 0.2 | 12.0 |
| EXAMPLE 20 29 | EVII | 80 | E | 10 | — | — | I | 20 | *4 | 0.2 | 12.0 |
| COMP.EX.10 30 | EIV | 80 | K | 10 | — | — | A | 20 | *5 | 0.2 | 11.8 |
| COMP.EX.11 31 | EV | 80 | D | 10 | — | — | B | 20 | *4 | 0.2 | 12.0 |
| COMP.EX.12 32 | EVI | 80 | N | 10 | — | — | C | 20 | *4 | 0.2 | 11.9 |
| COMP.EX.13 33 | EVII | 80 | L | 10 | — | — | H | 20 | *4 | 0.2 | 12.0 |

*1 Nygrosine base EX (made by Oriento Kagaku Kogyo K.K.)
*2 Carbon black MA#8 (made by Mitsubishi Kasei Kogyo K.K.)
*3 Phthalocyanine pigment (C.I.74160)
*4 Zinc complex type dye E-84 (made by Oriento Kagaku Kogyo K.K.)
*5 Chromecomplex type dye Spilon black TRH (made by Hodogaya Kagaku Kogyo K.K.)
*6 Quarternary ammonium salt P-51 (made by Oriento Kagaku Kogyo K.K.)

| Production of Carriers | |
|---|---|
| Ingredient | Parts by weight |
| Polyester resin (softening point: 123° C.; glass transition point: 65° C.; AV: 23; OHV: 40) | 100 |
| Fe—Zn family ferrite fine particles MFP-2 (made by TDK K.K.) | 500 |
| Carbon black (AM#8 made by Mitsubishi | 2 |

-continued

| Production of Carriers | |
|---|---|
| Ingredient | Parts by weight |
| Kasei Kogyo K.K.) | |

The above described materials were sufficiently mixed and ground in Henschel mixer and then molten and kneaded in the extrusion kneader of which cylinder portion was set at 180° C. and cylinder head portion was set at 170° C. The kneaded mixture was left as it was to be cooled and then roughly pulverized in feather mill followed by finely pulverizing in jet mill. The obtained particles were classified in classifier to obtain carriers having a mean particle size of 60 μm.

Evaluation Methods

The obtained toner 1 to 33, each of which of 100 parts by weight was subjected to the after-treatment with colloidal silica R-972 (made by Nihon Aerosil K.K.) of 0.1 part by weight, was evaluated on the following various kinds of characteristic. The results are shown in Table 3.

1. Content of the poorly charged toner (% by weight)

The toner 1 to 8 and 17 to 24 were blended with the above described carriers for 30 minutes at the ratio of the toner to the carrier of 7/93 to prepare the binary developing agent. The ordinary paper copying machine EP570Z (made by Minolta Camera K.K.) was used for the developing agent using the toner 5 and the ordinary paper copying machine EP-470Z (made by Minolta Camera K.K.) was used for the developing agents using the toner 1 to 4, 6 to 8 and 17 to 24. A quantity (% by weight) of the poorly charged toner contained in the toner at the first stage and after repeated 50,000 times and 100,000 times of copying process was measured.

Figure 2:
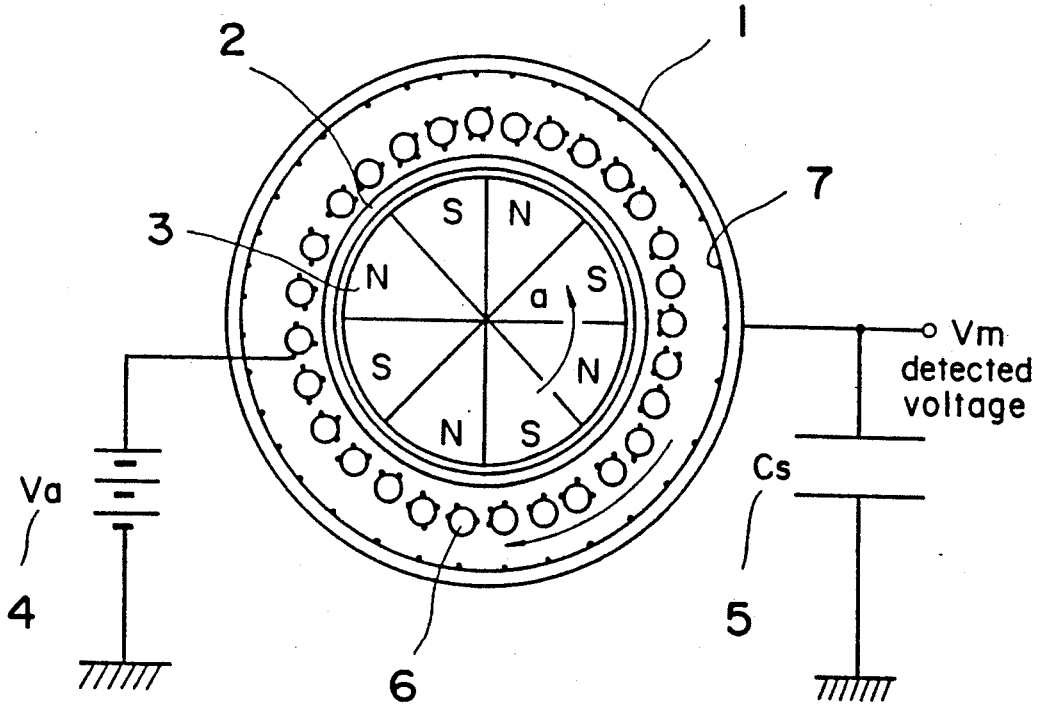
FIG. 2 is a schematic sectional view of an apparatus for measuring a charge amount of toner.

The quantity of the poorly charged toner was measured as follows. At first, the developing agent was sampled from 5 places within the developing machine about 1 g by about 1 g. The distribution of charging quantity of the toner for this developing agent was measured by the use of the apparatus published by Terasaka et al. of Minolta Camera K.K. in the 58th society for the study held on Nov. 28, 1986 under the auspices of the Society of Electronic Photography. Since the principle has been in detail described in the materials distributed in said society for the study, it is simply described here. Its construction is shown in FIG. 2.

A revolution frequency of a magnet roll (3) is set at 100 rpm and the developing agent of 3 g is weighed by means of a precision balance and placed uniformly all over the surface of an electrically conductive sleeve (2). Then, a bias voltage of 0 to 10 KV is successively applied from a bias power source (4) and the sleeve (2) is revolved for 5 seconds to read an electric potential Vm at the time when the sleeve (2) is stopped. At this time, a weight Mi of the toner (7) adhered to a cylindrical electrode (1) is measured by means of the precision balance to determine mean charging quantities at the respective applied voltages. The distribution of charging quantity of the toner contained in the developing agent can be measured by summarizing them.

The quantity (% by weight) of the toner having half or less of the mean charging quantity in the obtained distribution of charging quantity was investigated to define it as the content (% by weight) of the poorly charged toner.

2. Evaluation of Image Quality

After the above described content of the poorly charged toner had been measured, the standard chart made by Dataquest company was copied under the suitable exposure. to visually evaluate The fogs of the toner in the copied image on a white ground was evaluate visually and ranked. When the evaluation is the rank "Δ" or better, the toner can be put into practically use but the rank "o" or better is preferable.

3. Image Concentration

The concentration in the solid portion of copied images at the first stage in the measurement of the content of the poorly charged toner was measured by means of the Sakura densitometer.

4. Texture of Half-Concentration Portion

The texture of the half-concentration of copied images (cyan-colored solid portion on the chart) at the first stage in the measurement of the content of the poorly charged toner was visually evaluated to be ranked. When the rank is Δ or better, the toner can be put into practical use, but the rank "o" or better is preferable.

TABLE 3

| EXAMPLE COMPARATIVE EXAMPLE | Core particle (parts by weight) | Intermediate layer resin particle (parts by weight) | Outermost layer resin particle (parts by weight) | Content of poorly charged toner (% by weight) | | | Fogs on the copied image | | | Image conc. | Texture |
|---|---|---|---|---|---|---|---|---|---|---|---|
| | | | | Initial | After 50,000 | After 100,000 | Initial | After 50,000 | After 100,000 | | |
| EXAMPLE 1 | SI(80)ST70* | P(10)ST20 | K(20)ST0 | 0 | 1.0 | 1.0 | ○ | ○ | ○ | 1.4 | ○ |
| EXAMPLE 2 | SI(80)ST70 | E(10)ST30 | F(20)ST0 | 0 | 1.5 | 2.0 | ○ | ○ | ○ | 1.3 | ○ |
| EXAMPLE 3 | SII(80)ST70 | O(10)ST40 | Q(20)ST30 | 0 | 1.0 | 1.5 | ○ | ○ | Δ | 1.4 | ○ |
| EXAMPLE 4 | SII(80)ST70 | D(10)ST50 | P(20)ST20 | 0.5 | 2.0 | 4.5 | ○ | ○ | Δ | 1.3 | ○ |
| EXAMPLE 5 | SIII(80)ST70 | G(10)ST80 | L(20)ST100 | 0.5 | 2.5 | 5.0 | ○ | ○ | Δ | 1.4 | ○ |
| COMP.EX.1 | SI(80)ST70 | I(10)ST70 | J(20)ST70 | 0.5 | 9.0 | 14.0 | ○ | Δ | X | 1.4 | ○ |
| COMP.EX.2 | SII(80)ST70 | I(10)ST70 | G(20)ST80 | 0.5 | 8.5 | 10.0 | ○ | Δ | X | 0.7 | X |
| COMP.EX.3 | SII(80)ST70 | L(10)ST100 | H(20)ST100 | 0.5 | 11.5 | 18.5 | ○ | X | X | 0.7 | X |
| EXAMPLE 11 | EI(80) | C(10)ST90*1 | F(20)ST0 | 0 | 0.5 | 0.5 | ○ | ○ | ○ | 1.4 | ○ |
| EXAMPLE 12 | EI(80) | B(10)ST50 | K(20)ST0 | 0.5 | 1.0 | 2.0 | ○ | ○ | ○ | 1.4 | ○ |
| EXAMPLE 13 | EII(80) | C(10)ST90 | M(20)ST20 | 0 | 1.5 | 1.0 | ○ | ○ | ○ | 1.5 | ○ |
| EXAMPLE 14 | EII(80) | D(10)ST50 | F(20)ST0 | 0 | 1.0 | 0.5 | ○ | ○ | ○ | 1.4 | ○ |
| EXAMPLE 15 | EIII(80) | B(10)ST50 | M(20)ST20 | 0.5 | 2.5 | 1.5 | ○ | ○ | ○ | 1.3 | ○ |
| COMP.EX.7 | EI(80) | N(10)ST90 | C(20)ST90 | 1.5 | 8.5 | 13.0 | Δ | Δ | X | 0.7 | X |
| COMP.EX.8 | EII(80) | I(10)ST70 | J(20)ST70 | 1.0 | 10.5 | 15.0 | Δ | X | X | 0.6 | X |
| COMP.EX.9 | EIII(80) | B(10)ST50 | D(20)ST50 | 1.5 | *2 | — | Δ | *2 | — | 1.3 | X |

*Expressing the content (%) of styrenic monomers in the constituent resin.
*1Expressing the content (%) of styrenic monomers in the constituent resin.
*2The test was stopped after copying 5,000 times due to the increased flying.

Evaluation Methods

The obtained toner 9 to 16 and 25 to 33 were evaluated on the following various kinds of characteristic as follows. Each toner of 100 parts by weight was subjected to the after-treatment with colloidal silica R-972

(made by Nihon Aerosil K.K.) of 0.1 part by weight to be used for the evaluation of various kinds of characteristic. The results are shown in Table 4.

1. Content of fine particles (Measurement of the Distribution of Particle sizes

The toner produced according to Examples of the Production of the Toner 9 to 16 and 25 to 33 was mixed with the carrier shown in Examples of the Production of the Toner in a ratio of the toner to the carrier of 7/93 to prepare binary developing agents. The ordinary paper copying machine EP-470Z (made by Minolta Camera K.K.) was used for the developing agents containing the toner 12 and the ordinary paper copying machine EP-570Z (made by Minolta Camera K.K.) was used for the developing agents containing the toner 9 to 11, 13 to 16 and 25 to 33.

The amount of fine particles of toner was measured after the copying process was repeated 5,000 times as well as at the first stage.

In the content measurement of the fine particles, first, the particle size distribution by number was measured and the content of particles within the range of between 0.5 $\mu$ m or more and less than half of weight average particle size in the distribution measurement was represented by percent by weight.

The particle size distribution was measured as follows;

First, about 5 g of developer was sampled from 5 different portions in the developing device. The sample was dispersed in an aqueous solution containing a surfactant. The dispersion was subjected to an ultrasonic irradiation. Carrier particles were removed with magnet. Then, the particle size distribution was measured by SALD-1100 (made by Shimazu Seisakusho K.K.), which is a particle size distribution measuring machine of laser diffraction type;

The distribution of particle sizes of the toner was measured as follows. At first, the developing agent was sampled from 5 places within the developing device about 5 g by about 5 g to be dispersed in a aqueous system in which surfactants were dissolved. The resulting dispersion was irradiated with supersonic waves and then merely the carriers were removed by means of a magnet to measure the distribution of particle sizes of the toner by means of the laser diffraction apparatus for measuring the distribution of particles sizes SALD-1100 (made by Shimazu Seisakusho K.K.)

2. Durability Test With Respect to Copy (The number of sheets failed to be cleaned A standard chart of Dataquest Company was copied 100000 times under adequate irradiation conditions for the durability test with respect to copy. The results were ranked as follows depending upon the number of sheets of copy paper failed to be cleaned sufficiently. The number of sheets failed to be cleaned.

| | |
|---|---|
| 1 to 5,000 sheets | X |
| 5,001 to 50,000 sheets | Δ |
| 50,001 or more sheets | ○ |

3. Image Concentration

The concentration of the solid portion of the copied image in the first stage of the copying test was measured by means of the Sakura concentration meter.

4. Texture of the Half-concentration Portion

The texture of the half-concentration of copied images (cyan-colored solid portion on the chart) at the first stage in the durability test with respect to copy was visually evaluated to be ranked. When the rank is "Δ" or more, the toner can be put into practical use but the rank "o" or more are preferable.

TABLE 4

| EXAMPLE COMPARATIVE EXAMPLE | Core particle (parts by weight) | Intermediate layer resin particle (parts by weight) | Outermost layer resin particle (parts by weight) | Content of fine particles (number %) Initial 5000 times | After 5,000 times | Number of sheets failed to be cleaned (rank) | Image conc. | Texture of the half portion |
|---|---|---|---|---|---|---|---|---|
| EXAMPLE 6 | SI(80)ST70 | E(10)ST30 | H(20)ST100 | 10.3 | 17.3 | ○ | 1.4 | ○ |
| EXAMPLE 7 | SI(80)ST70 | D(10)ST50 | G(20)ST80 | 12.0 | 20.5 | ○ | 1.5 | ○ |
| EXAMPLE 8 | SII(80)ST70 | B(10)ST50 | H(20)ST100 | 11.0 | 13.5 | ○ | 1.4 | ○ |
| EXAMPLE 9 | SII(80)ST70 | C(10)ST90 | F(20)ST0 | 13.5. | 16.0 | ○ | 1.4 | ○ |
| EXAMPLE 10 | SIII(80)ST70 | E(10)ST30 | I(20)ST70 | 14.0 | 17.0 | ○ | 1.4 | ○ |
| COMP.EX.4 | SI(80)ST70 | I(10)ST70 | J(20)ST70 | 14.5 | 48.0 | X | 1.4 | ○ |
| COMP.EX.5 | SII(80)ST70 | I(10)ST70 | B(20)ST50 | 15.0 | 51.5 | X | 0.7 | X |
| COMP.EX.6 | SII(80)ST70 | D(10)ST50 | B(20)ST50 | 16.5 | 55.0 | X | 1.1 | Δ |
| EXAMPLE 16 | EIV(80) | A(10)ST0 | G(20)ST80 | 10.0 | 18.5 | ○ | 1.4 | ○ |
| EXAMPLE 17 | EIV(80) | J(10)ST70 | H(20)ST100 | 11.5 | 21.0 | ○ | 1.4 | ○ |
| EXAMPLE 18 | EV(80) | F(10)ST0 | L(20)ST100 | 11.0 | 19.0 | ○ | 1.3 | ○ |
| EXAMPLE 19 | EVI(80) | M(10)ST0 | L(20)ST100 | 11.5 | 15.5 | ○ | 1.4 | ○ |
| EXAMPLE 20 | EVII(80) | E(10)ST30 | I(20)ST70 | 13.0 | 17.0 | ○ | 1.4 | ○ |
| COMP.EX.10 | EIV(80) | K(10)ST0 | A(20)ST0 | 14.0 | 46.5 | X | 1.3 | ○ |
| COMP.EX.11 | EV(80) | D(10)ST50 | B(20)ST50 | 13.5 | 49.0 | X | 0.8 | X |
| COMP.EX.12 | EVI(80) | N(10)ST90 | C(20)ST90 | 14.0 | 51.5 | X | 1.3 | ○ |
| COMP.EX.13 | EVII(80) | L(10)ST100 | H(20)ST100 | 14.5 | 44.0 | Δ | 1.1 | Δ |

What is claimed is:

1. Toner for the development of electrostatic latent images comprising a core particle comprising at least styrene-acrylic copolymer, an intermediate layer coating the core particle and comprising at least styrene-acrylic copolymers, and an outermost surface layer coating the intermediate layer and comprising at least styrene-acrylic copolymers, an absolute value (%) of the difference between $S_0$(%) and $S_1$ (%) represented by the formula ($|S_0-S_1|$)

in which $S_0$ is a content (%) of styrenic monomer component in the styrene-acrylic copolymers of which the core particle is formed, and $S_1$ is a content (%) of styrenic monomer component in the styrene-acrylic copolymers of which the intermediate layer is formed, being 10% or more, and an absolute value (%) of the difference between $S_1$ (%) and $S_2$ (%) represented by the formula ($|S_1-S_2|$)

in which $S_1$ is a content (%) of styrenic monomer component in the styrene-acrylic copolymers of which the intermediate layer is formed and $S_2$ is a content (%) of styrenic monomer component in the styrene-acrylic copolymers of which the outermost surface is formed, being 5% or more, and the relationship among $S_0$, $S_1$ and $S_2$ satisfies the following formula;

$$S_0>S_1>S_2 \text{ or } S_0<S_1<S_2.$$

2. Toner of claim 1, in which $S_0$ is within the range of between 30% and 90%.

3. Toner of claim 1, wherein $S_1$ is at least 5%.

4. Toner of claim 1, wherein $S_0$, $S_1$ and $S_2$ satisfy the relationship of $|S_0-S_1|>|S_1-S_2|$.

5. Toner of claim 1, wherein when $S_0$, $S_1$ and $S_2$ satisfy the relationship of $S_0>S_1>S_2$, the toner is positively chargeable.

6. Toner of claim 1, wherein when $S_0$, $S_1$ and $S_2$ satisfy the relationship of $S_0<S_1<S_2$, the toner is negatively chargeable.

7. Toner of claim 1, wherein the outermost surface layer contains a charge controlling agent.

8. Toner of claim 7, wherein the content of the charge controlling agent is 0.1 to 10 parts by weight on the basis of 100 parts by weight of the resins of which the outermost surface layer is formed.

9. Toner of claim 1, wherein the acrylic monomer component of the styrene-acrylic copolymer resins of which the outermost surface layer is formed contains a nitrogen-containing polar group or a fluorine atom.

10. Toner of claim 1 having a coefficient of variation of less than 20% in particle size of the toner.

11. Toner for the development of electrostatic latent images comprising a core particle comprising at least polyester resins, an intermediate layer coating the core particle and comprising at least styrene-acrylic copolymers, and an outermost surface layer coating the intermediate layer and comprising at least styrene-acrylic copolymers, an absolute value (%) of the difference between $S_1$ (%) and $S_2$ (%) represented by the formula ($|S_1-S_2|$)

in which $S_1$ is a content (%) of styrenic monomer component in the styrene-acrylic copolymers of which the intermediate layer is formed and $S_2$ is a content (%) of styrenic monomer component in the styrene-acrylic copolymers of which the outermost surface is formed, being 5% or more.

12. Toner of claim 11, wherein $S_1$ and $S_2$ satisfy the relationship of $S_1>S_2$.

13. Toner of claim 12, wherein $S_1$ is within the range of between 10 and 100%.

14. Toner of claim 12 being positively chargeable.

15. Toner of claim 11, wherein $S_1$ and $S_2$ satisfy the relationship of $S_1<S_2$.

16. Toner of claim 15, wherein $S_1$ is within the range of between 0 and 90%.

17. Toner of claim 15 being negatively chargeable.

18. Toner of claim 11, wherein the outermost surface layer contains a charge controlling agent

19. Toner of claim 11, wherein the acrylic monomer component of the styrene-acrylic copolymer resins of which the outermost surface layer is formed contains a nitrogen-containing polar group or a fluorine atom.

20. Toner for the development of electrostatic latent images comprising a core particle comprising at least styrene-acrylic copolymer, an intermediate layer coating the core particle and comprising at least styrene-acrylic copolymers, and an outermost surface layer coating the intermediate layer and comprising at least styrene-acrylic copolymers, an absolute value (%) of the difference between $S_0$(%) and $S_1$ (%) represented by the formula ($|S_1-S_0|$) in which $S_0$ is a content (%) of styrenic monomer component in the styrene-acrylic copolymers of which the core particle is formed, and $S_1$ is a content (%) of styrenic monomer component in the styrene-acrylic copolymers of which the intermediate layer is formed, being 10% or more, and an absolute value (%) of the difference between $S_1$ (%) and $S_2$ (%) represented by the formula ($|S_2-S_1|$)

in which $S_1$ is a content (%) of styrenic monomer component in the styrene-acrylic copolymers of which the intermediate layer is formed and $S_2$ is a content (%) of styrenic monomer component in the styrene-acrylic copolymers of which the outermost surface is formed, being 10% or more, and the relationship among $S_0$, $S_1$ and $S_2$ satisfying the following formula;

$$S_0>S_1 \text{ and } S_1<S_2, \text{ or}$$

$$S_0<S_1 \text{ and } S_1>S_2, \text{ and}$$

a coloring agent being contained in the core particle and/or the intermediate layer, and the coloring agent-containing layer being formed of styrene-acrylic copolymers having the lowest viscosity.

21. Toner of claim 20, wherein $S_0$ is within the range of between 30% and 90%.

22. Toner of claim 20, wherein $S_0$ is larger than $S_1$, $S_1$ is lower than $S_2$ and the toner is negatively

23. Toner of claim 20, wherein $S_0$ is lower than $S_1$, $S_1$ is larger than $S_2$ and the toner is positively chargeable.

24. Toner for the development of electrostatic latent images comprising core particles comprising at least thermoplastic resin and having a means particle size of 1 to 20 μm, an intermediate layer comprising at least styrene-acrylic copolymers and having a layer thickness of 0.05 to 4 μm, an outermost surface layer comprising at least styrene-acrylic copolymers and a charge controlling agent, and having a layer thickness of 0.05 to 4 μm, an absolute value (%) of the difference between $S_1$ (%) and $S_2$ (%) represented by the formula ($|S_1-S_2|$)

in which $S_1$ is a content (%) of styrenic monomer component in the styrene-acrylic copolymers of which the intermediate layer is formed and $S_2$ is a content (%) of styrenic monomer component in the styrene-acrylic copolymers of which the outermost surface is formed, being 5% or more, and a coloring agent being contained in the core particles and/or the intermediate layer.

25. Toner of claim 24, wherein the layer containing the coloring agent is comprised of resin having the temperature (Tf) of 60° to 150° C. at which the viscosity of the resin reaches about $10^6$ poise.

* * * * *